United States Patent [19]

Hurley

[11] 4,036,100

[45] July 19, 1977

[54] APPARATUS AND METHOD FOR LOADING FLUENT EXPLOSIVES IN UPWARDLY EXTENDING BOREHOLES

[75] Inventor: Eldon Kenneth Hurley, Carthage, Mo.

[73] Assignee: Hercules Incorporated, Wilmington, Del.

[21] Appl. No.: 693,659

[22] Filed: June 7, 1976

[51] Int. Cl.[2] ..... F42D 1/08

[52] U.S. Cl. ..... 86/20 C; 102/23; 166/207

[58] Field of Search ..... 86/20 C; 102/23, 22; 166/207; 299/13

[56] References Cited

U.S. PATENT DOCUMENTS

| | | | |
|---|---|---|---|
| 913,745 | 3/1909 | Malcolm | 86/20 C X |
| 1,627,991 | 5/1927 | Owen | 102/23 |
| 1,946,780 | 2/1934 | Costello | 86/20 C |
| 2,818,809 | 1/1958 | Roy | 86/20 C X |
| 3,104,584 | 9/1963 | Jacobs | 102/22 X |
| 3,170,366 | 2/1965 | Alfredsson | 86/20 C |
| 3,175,618 | 3/1965 | Lang et al. | 166/207 X |
| 3,812,912 | 5/1974 | Wuenschel | 166/207 |

*Primary Examiner*—David H. Brown
*Attorney, Agent, or Firm*—Joshua W. Martin, III

[57] ABSTRACT

Apparatus for loading an upwardly extending borehole with a fluent explosive, including a tubular member extending along a portion of its length into the borehole, a conduit axially extending into the external open end section of the tubular member to a point short of the borehole face, and means for collapsing the tubular member intermediate the end of the conduit therein and the borehole face.

The tubular member is outwardly expanded along at least a portion of its periphery and length in the borehole into impact engagement with the borehole wall by force of detonation generated within said length portion, for support in the borehole and for closing the borehole sufficiently to preclude gravitation of fluent explosive through the annulus formed by the tubular member and the borehole wall when the explosive is conveyed into the borehole through the tubular member. The conduit is supported within the tubular member by means within the conduit-tubular member annulus concomitantly closing the annulus sufficiently to preclude gravitation therethrough of fluent explosive conveyed into the tubular member from the conduit.

The apparatus provides for charging the explosive through the conduit and into, and generally completely through, the tubular member for detonation after which the tubular member is collapsed to retain the explosive in emplacement; and for removal of the collapsing means and conduit and its support means from the system prior to detonation of the emplaced charge. Means for detonation of the emplaced charge, and method, are also provided.

16 Claims, 7 Drawing Figures

APPARATUS AND METHOD FOR LOADING FLUENT EXPLOSIVES IN UPWARDLY EXTENDING BOREHOLES

This invention relates to apparatus and method for loading fluent explosives into upwardly extending boreholes. Other aspects will be apparent in light of the accompanying disclosure and the appended claims.

In the use of explosives in mining, boreholes for receiving the explosives are often of necessity drilled upwardly into the earth formation. Such upwardly extending boreholes are often referred to as up-holes, and they present serious loading problems when the explosive is fluent inasmuch as the explosive must be supported in position against the force of gravity. Exemplary of fluent explosives often utilized are the well-known inorganic oxidizer salt explosives of the aqueous slurry type.

Heretofore, loading up-holes with fluent explosives has generally involved use of a loading tube fitted to the borehole and sealed in place with a suitable sealing material, together with a valve at the open end of the tube outside the borehole and a pump connecting with the valve for delivery of the explosive through the valve and loading tube into the borehole; the valve thereafter being closed to prevent gravitation of the explosive from the borehole with removal of the pump from the system prior to the shot. This procedure is unduly time-consuming, particularly from the standpoint of the requisite delay incurred with the use of a sealing material requiring a cure period, such as an epoxy resin or concrete; and the valve assembly for retaining the fluent explosive in the loading tube is lost to the force of the explosion.

This invention is concerned with method and apparatus for loading up-holes with a fluent explosive without the attendant time and equipment requirements characteristic of such loading operations heretofore.

In accordance with the invention, apparatus is provided for loading an upwardly extending borehole with a fluent explosive, which comprises an open tubular member extending along a portion of its length into said borehole to thereby retain an open end section thereof outside said borehole;

a conduit for conveying flow of said fluent explosive into said tubular member for detonation in said borehole, axially extending into said open end section of said tubular member through said open end thereof and terminating intermediate the ends of said open end section, and means within the resulting annulus for support of said conduit in said tubular member and concomitantly closing said annulus sufficiently to preclude gravitation therethrough of said explosive conveyed from said conduit;

said tubular member peripherally expanded along at least a portion of its length in said borehole, by force of detonation generated within said length portion, into engaging impact with the adjacent borehole wall for support of said tubular member in said borehole and for closing said borehole sufficiently to preclude gravitation of said fluent explosive through the annulus formed by said tubular member and said borehole wall when said explosive is conveyed into said borehole through said tubular member; and means for collapsing said open end section of said tubular member intermediate the end of said conduit therein and the end of said open end section adjacent to the borehole face sufficiently to preclude gravitation of said explosive from said tubular member through the resulting collapsed open end portion thereof.

Although the tubular member can be peripherally expanded about its entire periphery and along substantially its entire length within the borehole, peripheral expansion along only a section of its length therein generally provides for the requisite impact engagement with the borehole, and, often, impact engagement of the tubular member about only a portion of its periphery is sufficient.

Although the explosives conveying conduit can be supported by any suitable means disposed in the tubular memberconduit annulus in the requisite closing relationship therewith, an inflatable tubular collar disposed around at least a portion of the conduit length within the tubular member and inflated into biased contact with the adjacent tubular member and conduit surfaces is now preferred. Alternatively preferred is a compressible material similarly placed in the tubular memberconduit annulus, and compressed linearly along the conduit and concomitantly laterally expanded into biased contact with the adjacent tubular member and conduit surfaces.

Now preferred means for collapsing the tubular member when containing fluent explosives conveyed through the conduit, is a clamp assembly encompassing the tubular member section to be collapsed and including a pair of opposing arms tangentially facing the tubular member and at least one of the arms being movable toward the other into the requisite collapsing contact with the tubular member.

Further, in accordance with the invention, a method is provided for loading an upwardly extending borehole with a fluent explosive, comprising extending into said borehole an open tubular member peripherally expandable along a length thereof in said borehole, by action of force of detonation generated within said length, but retaining an open end section of said tubular member outside said borehole:

detonating an explosive within said tubular member in said borehole to responsively expand the same peripherally into engaging impact with the adjacent borehole wall for support of said tubular member in said borehole and for closing said borehole sufficiently to preclude gravitation of said fluent explosive from said borehole intermediate said tubular member and said borehole wall when said explosive is conveyed into said borehole through said tubular member;

extending a conduit axially into said tubular member through the open end of said open end section and into said open end section to a point intermediate said open end and the face of said borehole, and disposing means in the resulting annulus for support of said conduit in said tubular member and for closing said annulus sufficiently to preclude gravitation therethrough of fluent explosive when said explosive is conveyed into said tubular member through said conduit;

introducing said fluent explosive through said conduit and through at least a portion of said tubular member for detonation in said borehole, and thereafter collapsing a section of said tubular member intermediate the end of said conduit therein and the face of said borehole sufficiently to preclude gravitation of said explosive from said tubular member through the resulting collapsed section thereof.

The invention is further illustrated with reference to the drawings of which

Figure 1:
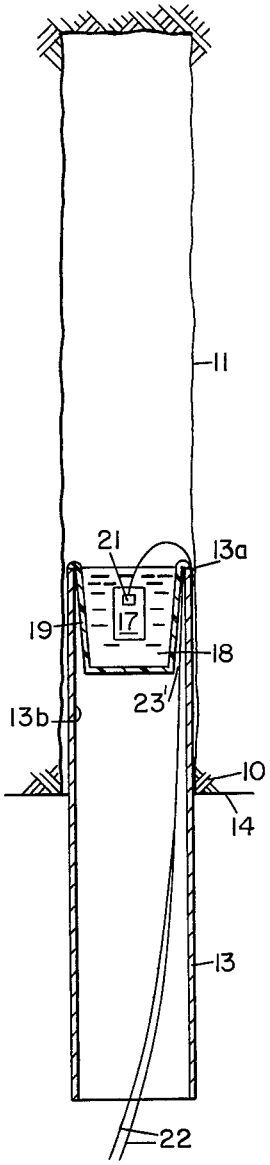
FIG. 1 is a view of the tubular member for receiving fluent explosive to be emplaced in the borehole together with an explosive charge supported in the forward end for detonation to expand the tubular member into engaging impact with the borehole wall.

Referring to FIG. 1, earth formation 10 contains upwardly extending borehole 11 to be charged with a fluent explosive such as of the aqueous slurry inorganic oxidizer salt type 12 (see FIG. 4) for detonation to form earth breakage product. Tubular loading member 13 extends into borehole 11 for delivery of fluent explosive, generally terminating in the borehole at a point where it reaches competent rock, which can be at any point in borehole 11.

Tubular member 13 is fabricated from any suitable material, generally a metal such as Schedule 5 or 10 steel, which is outwardly expandable when in the borehole into engaging impact along its length within the borehole 11 by force of detonation of a high explosive charge 17 supported in forward end 13a of tubular member 13, immersed in a body of water 18 in a cup support 19. In the embodiment shown, the charge 17 such as PETN, is cap-sensitive and is in detonating relationship with an electric blasting cap 21 supported therein and connecting through lead wires 22 extending through annulus 23 formed by cup 19 and the inner wall 13b of tubular member 13 to a suitable source of firing current, not shown. Cup 19 is supported in forward end 13*a* of tubular member 13 in any suitable manner. Generally, cup 19 is lipped outwardly at its open end and is then seated along its lipped end on the forward end 13*a* of tubular member 13. High explosive 17 with electric blasting cap 21 in water body 18, and lead wires 22, are emplaced in cup 19 in any suitable manner prior to seating the lipped cup on the tubular member. Generally, the entire cup assembly, including lead wires 22, is in place at the forward end 13*a* of tubular member 13 at the time member 13 is extended into borehole 11, so that upon emplacement of tubular member 13 the entire assembly, including lead wires 22 extended through annulus 23 for connection to the power source, is complete.

Figure 2:
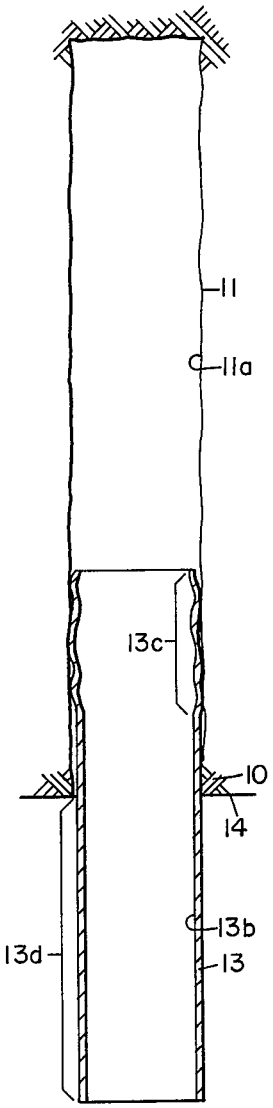
FIG. 2 is a view of the tubular member of FIG. 1 supported in the borehole in engaging impact relationship with the borehole wall.

Tubular member 13 and associated assembly of cup 19, explosive 17, water body 18, blasting cap 21 and lead wires 22, is supported in borehole 11 in any suitable manner while awaiting detonation of charge 17, such as by a wedge shape support member driven at the borehole face into the annulus formed by tubular member 13 and the borehole wall 11*a*. Upon detonation of charge 17, the resulting force of detonation peripherally drives the forward end section 13*c* of tubular member 13 outwardly into impact engaging contact with borehole wall 11*a* to thereby provide tubular member 13 fully supported in borehole 11 by suspension from borehole wall 11*a*, and in the requisite closing relationship with borehole 11 to preclude gravitation of fluent explosive from borehole 11 intermediate tubular member 13 and the borehole wall 11*a*, as above described and as further illustrated with reference to FIG. 2.

Although tubular member 13 extends into borehole 11 any suitable distance, an open end section 13*d* (see FIG. 2) thereof is retained outside borehole 11. Feed conduit 24 for conveying flow of fluent explosive into tubular member 13 for detonation in borehole 11 axially extends into and through open end 13*e* and into open end section 13*d* of tubular member 13 to an intermediae point in end section 13*d*.

Inflatable tubular collar 26 is disposed around a forward section 24*a* of conduit 24 to be axially extended into tubular member 13 and is supported intermediate, and by, opposing stationary support plates 27 and 28 fixed to the exterior wall of conduit section 24*a* and extending radially therefrom toward inner wall 13*b* of conduit 13. Line 26*b* extends from within collar 26 through plate 28 to fluid flow regulation means, generally air (not shown), for conveying fluid into and from collar 26 for inflating and deflating same. Support plates 27 and 28, rigidly fixed to conduit section 24*a*, serve to support inflatable collar 26 around conduit 24 for inflation and deflation of same; and they also serve as a guide for annularly extending conduit 24 into tubular member 13, and to confine collar 26 during extension and retraction of same into, and from, tubular member 13.

Valve 29 outside borehole 11, and connecting with conduit 24 admits flow of fluent explosive 12 from storage via line 31 into conduit 24 and hence into tubular loading member 13 for detonation in borehole 11. Fluent explosive from conduit 24 is conveyed into, or through, tubular member 13 for the detonation to completely, or partially, fill borehole 11 as desired.

Inflatable collar 26 supported by plates 27 and 28 is deflated during extension of conduit 24 into tubular member 13 but is then inflated, and in its inflated form it is precluded from linear expansion along conduit 24 beyond plates 27 and 28; but it concomitantly expands laterally into biased contact with the inner wall surface 13*b* of tubular member 13 and the external wall of conduit 24 to thus support conduit 24 in open end section 13*d*, and to sufficiently close annulus 16 between conduit 24 and inner wall 13*b* to preclude gravitation of fluent explosive delivered into tubular member 13 through conduit 24.

Figure 3:
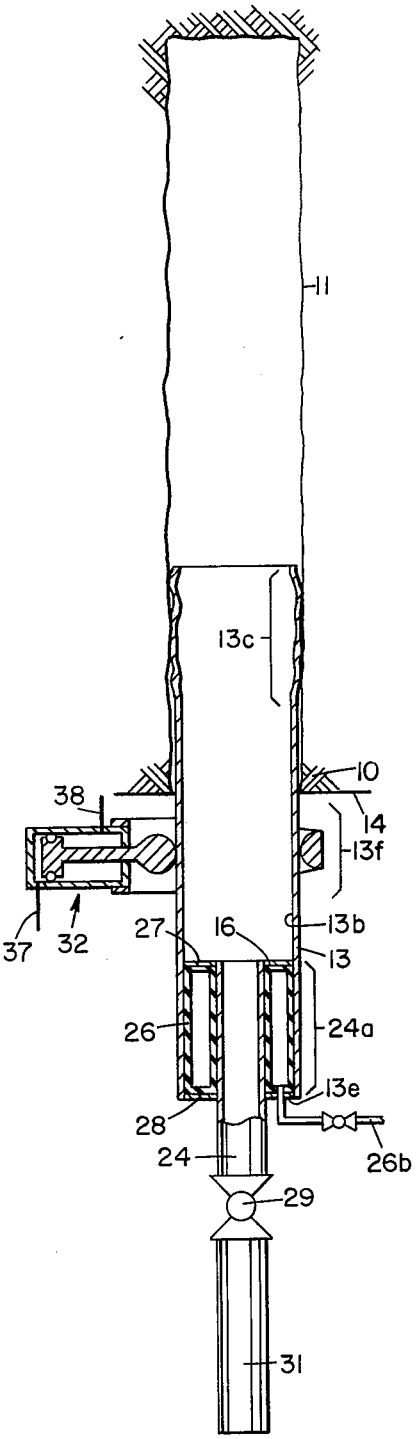
FIG. 3 is a view of the assembly of FIG. 2 additionally containing a fluent explosive loading conduit extending axially into the tubular member and supported by an inflated collar as biased closure means for the annulus, along with means for collapsing the tubular member for retaining the fluent explosive therein.
Figure 3A:
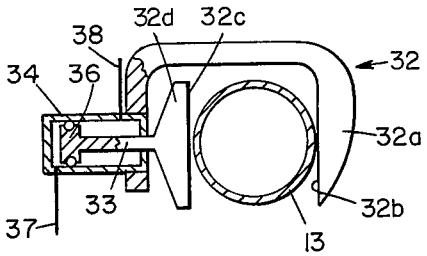
FIG. 3A is a more detailed view of the collapsing means of FIG. 3.

Clamp assembly 32 for collapsing tubular member 13 encompasses a linearly extending section 13*f* of tubular member 13 intermediate the end of conduit 24 in tubular member 13 and the face 14 of borehole 11. The clamp assembly 32, see also FIG. 3A, includes stationary arm 32*a* having linearly extending bearing surface 32*b* tangentially facing tubular member 13 in substantial contact therewith, and opposing linearly extending bearing surface 32*c* of movable arm 32*d* also tangentially facing tubular member 13 but connecting with piston rod 33 in hydraulic cylinder 34 containing piston 36 with fluid conduits 37 and 38 for conducting flow of fluid into and from cylinder 34 for regulating forward and rearward travel of piston 36.

Piston rod 33 supports linearly movable arm 32*d* and bearing surface 32*c* is opposing and substantially parallel relationship with stationary arm 32*a* and bearing surface 32*b*, and both arm 32*d* and 32*a* are disposed in substantial contact with, or in close proximity to, tubular member 13. When the explosive loading step is completed, tubular member 13 is forcibly collapsed by forward motion of piston 36 to thus move piston rod 33 and linear bearing surface 32*c* against tubular member 13 and stationary linear surface 32*b* to thus crush, or collapse, tubular member 13 to sufficiently close tubular member 13 to preclude gravitation of fluent explosive therefrom. After collapse of member 13, inflated collar 26 is deflated by discharge of fluid therefrom (generally air) via line 26*b* in response to which the entire conduit 24 assembly including conduit 24 and support plates 27 and 28 attached thereto, with deflated collar 26, fall away from the apparatus; and thereafter, piston 36 is moved away from tubular member 13 for release of clamp 32 from the system prior to the detonation to provide the loaded borehole as illustrated with reference to FIG. 4.

Figure 4:
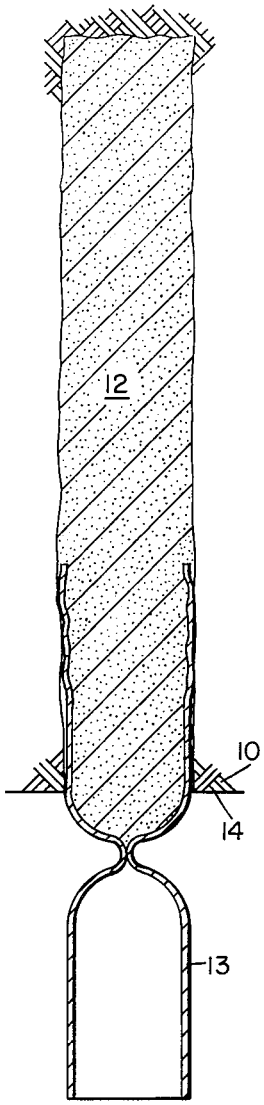
FIG. 4 is a view of the loaded tubular member of FIG. 3 after collapse of the tubular explosives receiving member for retaining the fluent explosive therein and after removal of the loading conduit and collapsing means to await detonation.
Figure 6:
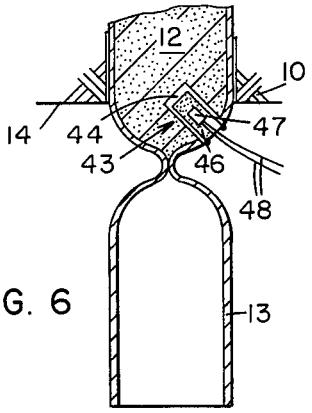
FIG. 6 illustrates means for detonating the emplaced fluent explosive charge. Like parts in the drawings are designated by like numbers.

Explosive charge 12 in tubular member 13 and borehole 11 can be detonated in any suitable manner. For example, and with reference to FIG. 6 which illustrates means for detonating a charge 12 emplaced as shown in FIG. 4, when charge 12 is a capinsensitive aqueous slurry type inorganic oxidizer salt explosive, it can be detonated by a conventional booster type assembly 43, supported in detonating relationship with charge 12 in tubular well member 44 which extends into charge 12 through a side wall of tubular member 13 intermediate the collapsed end of tubular member 13 and the face 14 of borehole 11. An exemplary booster assembly 43 is 200 grams PETN 46 and a No. 6 or No. 8 electric blasting cap 47 embedded in charge 46 in detonating relationship therewith and connecting through electric lead wires 48 with a suitable electric power source not shown. Other suitable booster charges 46 include RDX, Tetryl and the like. In the event that charge 12 is capsensitive, a suitable blasting cap can be supported alone in well member 44 in the requisite detonating relationship with charge 12.

Figure 5:
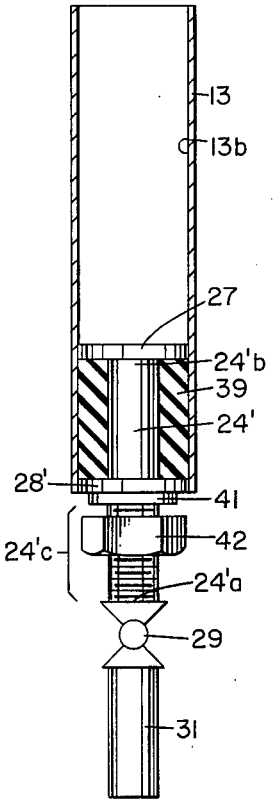
FIG. 5 shows another embodiment of means for support of the loading conduit in the tubular explosives receiving member.

Referring to FIG. 5, conduit 24' connects at its bottom end 24'*a* with valve 29 and at its top end 24'*b* with radially extending support plate 27. Support plate 28' is spaced downwardly from plate 27, and compressible material 39 is peripherally disposed around conduit 24' intermediate plates 27 and 28'. Plates 27 and 28' serve to support compressible member 39 in the same manner as illustrated with reference to plates 27 and 28 and inflatable collar 26 of FIG. 3, except that plate 28' in its radially extending position is linearly movable toward plate 27 to press against compressible material 39 and concomitantly cause material 39 to expand laterally into biased contact with conduit 24' and inner wall 13*b* of tubular member 13.

Conduit 24' is threaded along a lower end section 24'*c* extending toward, and terminating in close proximity to, support plate 28'. Bushing 41 radially extending from conduit 24' below plate 28' is movable in its radially extending position substantially coaxially along conduit 24' in response to pressing action of tightening nut 42 threadably engaged with the threaded end 24'*c* of conduit 24' and rotatably movable thereon into, and from, pressing contact of material 39 with conduit 24' and inner wall 13*b* of tubular member 13 to cause compressible material 39 to laterally expand into, or retract from, biased contact with conduit 24' and inner wall 13*b* of tubular member 13. Generally, conduit 24', support plates 27 and 28', tightening nut 42, bushing 41 and uncompressed elastomer 39 are assembled outside conduit 24' and then extended as a unit into tubular member 13, after which tightening nut 42 is advanced to cause lateral expansion of member 39 for biased supporting contact with inner wall 13*b* and conduit 24'.

In accordance with a preferred method embodiment, an inwardly tapered cup 19 and associated detonation assembly emplaced therein, viz. charge 17, blasting cap 21 and lead wires 22, immersed in water body 18, is placed in open end 13*a* of tubular member 13 prior to emplacement of tubular member 13 in borehole 11. The tubular loading member 13 and associated detonation assembly emplaced therein, is then extended axially into borehole 13 as illustrated with reference to FIG. 1. Alternatively, charge 17 can be an extruded booster-type charge immersed in a body of water or other suitable liquid within a container; and the thus loaded container is placed within the end 13*a* of the tubular member.

At this point, charge 17 is detonated, and in response to force of the detonation the wall section 13*c* is driven outwardly into engaging impact with the inner wall surface 11*a* of the borehole. The collapsing means such as system 32 is then secured to the open end section 13*f* and the feed conduit 24 with associated collar 26 and plate structure (27, 28) affixed thereto is extended into the tubular loading member 13 as illustrated with reference to FIG. 3, after which the collar 26 is inflated to secure the forward section 24*a* of conduit 24 in substantially fluidtight relationship with tubular member 13. A stream of fluent explosive 12 is then admitted through valve 29 into and through conduit 24 into tubular member 13 in any suitable amount generally in amount sufficient to overflow tube 13 and fill substantially the remainder of the borehole. Valve 29 is then closed and the clamp assembly 32 is actuated to forcibly collapse tubular member 13 for retaining fluent explosive 12 therein. Collar 26 is then deflated and the entire assembly of conduit 24, collar 26 and plates 27 and 28, is dropped from the open end section 13*d* of tubular member 13; and, thereafter clamp 32 is removed from conduit 24 after reverse travel of piston 36 in cylinder 24, thus leaving the assembly of FIG. 4 intact and ready for association with a detonator for the detonation of charge 12.

Although any suitable explosive 17 can be utilized, PETN, RDX, Tetryl, and the like are now preferred, and generally an electric blasting cap of No. 6 to No. 8 strength is advantageously used for initiating detonation of that charge.

When referring herein to a fluent explosive, it is meant one which is sufficiently flowable to gravitate at the time, and after, it is emplaced in the up-hole, independently of whether it may subsequently undergo sufficient viscosity increase, such as by gelation, to be no longer gravitatable from emplacement.

What I claim and desire to protect by Letters Patent is:

1. Apparatus for loading an upwardly extending borehole with a fluent explosive comprising an open tubular member annularly extending along a portion of its length into said borehole to thereby retain an open end section thereof outside said borehole;

a conduit for conveying flow of said explosive into said tubular member for detonation in said borehole, axially extending into said open end section of said tubular member through said open end thereof and terminating intermediate the ends of said open end section, and means within the resulting annulus for support of said conduit in said tubular member and concomitantly closing said annulus sufficiently to preclude gravitation therethrough of said explosive conveyed from said conduit;

said tubular member peripherally expanded along at least a portion of its length in said borehole, by force of detonation generated within said length portion, into engaging impact with the adjacent borehole wall for support of said tubular member in said borehole and for closing said borehole sufficiently to preclude gravitation of said fluent explosive from said borehole intermediate said tubular member and said borehole wall when said explosive is conveyed into said borehole through said tubular member; and means for collapsing said open end section of said tubular member intermediate the end of said conduit therein and the end of said open end section adjacent to the borehole face sufficiently to preclude gravitation of said explosive from said tubular member through the resulting collapsed open end portion thereof.

2. The apparatus of claim 1 including means for support of a detonator for said fluent explosive in operative communication with the interior of said tubular member for detonation of said fluent explosive with present therein.

3. A method for loading a fluent explosive into an upwardly extending borehole, comprising extending into said borehole an open tubular member peripherally expandable along a length thereof in said borehole by action of force of detonation generated within said length portion, but retaining an open end section of said tubular member outside said borehole;

detonating an explosive within said tubular member in said borehole to responsively expand same peripherally into engaging impact with the adjacent borehole wall for support of said tubular member in said borehole and for closing said borehole sufficiently to preclude gravitation of said fluent explosive intermediate said tubular member and said borehole wall when said explosive is conveyed into said borehole through said tubular member;

extending a conduit annular into said tubular member through the open end of said open end section and into said open end section to a point intermediate said open end and the face of said borehole, and disposing means in the resulting annulus for support of said conduit in said tubular member and for closing said annulus sufficiently to preclude gravitation therethrough of fluent explosive when said explosive is conveyed into said tubular member through said conduit;

introducing said fluent explosive through said conduit and through at least a portion of said tubular member for detonation in said borehole, and thereafter collapsing a section of said tubular member intermediate the end of said conduit therein and the face of said borehole sufficiently to preclude gravitation of said explosive from said tubular member through the resulting collapsed section thereof.

4. In a method of claim 3, supporting a detonator for said fluent explosive in operative communication with the interior of said tubular member for detonation of said explosive when present therein.

5. Apparatus for loading an upwardly extending borehole with a fluent explosive, comprising:

a tubular member partially extending into said borehole having a first open end within said borehole and a second open end outside of said borehole;

means for radially expanding said tubular member along a portion of its length in said borehole into engaging contact with the adjacent borehole wall for support of said tubular member in said borehole and for closing a first space between said tubular member and said borehole wall sufficiently to prevent gravitation of said fluent explosive from said borehole when said fluent explosive is conveyed into said borehole through said tubular member;

a conduit extending into said tubular member through said second open end thereof and having its upper end positioned below said borehole;

means within a second space between said tubular member and said conduit for supporting said concuit in said tubular member and for preventing gravitation of said fluent explosive through said space; and means for collapsing a portion of said tubular member below said borehole and above said upper end of said conduit.

6. The apparatus of claim 5 wherein said means for collapsing said tubular member includes a clamp emcompassing the external wall of said tubular member, said clamp having a pair of opposing arms each tangentially facing said tubular member, and means for moving at least one of said arms toward the other in collapsing contact with said tubular member.

7. The apparatus of claim 5 including means for introducing said fluent explosive through said conduit, through a portion of said tubular member and into said borehole.

8. The apparatus of claim 5 wherein said means within said second space includes a compressible material around said conduit in contact with the outer wall of said conduit and the inner wall of said tubular member.

9. The apparatus of claim 8 wherein said means within said second space includes a pair of plate members positioned on opposite sides of said compressible material which enclose said compressible material within said second space, wherein one of said plate members is rigidly supported by said conduit and the other plate member is linearly movable along said conduit toward said rigidly supported plate member.

10. The apparatus of claim 5 wherein said means within said second space includes an inflatable tubular collar around said conduit to close at least a portion of said space when inflated.

11. The apparatus of claim 1 wherein said means within said second space includes means for support of said inflatable tubular collar and means for inflating said tubular collar.

12. The apparatus of claim 11 wherein said means for support of said inflatable tubular collar includes a pair of plate members positioned on opposite sides of said inflatable tubular collar within said second space.

13. A method for loading a fluent explosive into an upwardly extending borehole, comprising:

inserting into said borehole an open tubular member, retaining an open end of said tubular member outside said borehole;

expanding a portion of said tubular member into engaging contact with the adjacent borehole wall for support of said tubular member in said borehole and for closing a first space between said tubular member and said borehole wall to prevent gravitation of said fluent explosive therebetween when said fluent explosive is conveyed through said tubular member into said borehole;

inserting a conduit axially into said tubular member through said open end of said tubular member outside of said borehole to a height wherein the upper end of said conduit is below said borehole;

supporting said conduit in said tubular member;

closing at least a portion of a second space between said conduit and said tubular member sufficiently to prevent gravitation therebetween of fluent explosive when said fluent explosive is conveyed through said tubular member into said borehole;

introducing said fluent explosive through said conduit, through a portion of said tubular member and into said borehole;

collapsing a portion of said tubular member below said borehole and above said upper end of said conduit sufficiently to prevent gravitation of said fluent explosive from said tubular member through the collapsed portion thereof.

14. The method of claim 13, wherein supporting said conduit in said tubular member includes emplacing an inflatable tubular collar around a length of said conduit within said tubular member.

15. The method of claim 13, wherein supporting said conduit and said tubular member includes emplacing a compressible material around a length of said conduit within said tubular member.

16. The method of claim 13 including emplacing an inflatable tubular collar around an end of a conduit prior to inserting into said borehole an open tubular member; and after inserting said conduit into said tubular member, inflating said collar into contact with a portion of the inner wall of said tubular member and a portion of outer wall of said conduit to support said conduit within said tubular member and to close at least a portion of said second space sufficiently to prevent gravitation therebetween of fluent explosive when said fluent explosive is conveyed through said tubular member into said borehole.

* * * * *